US005190252A

United States Patent [19]

Schrager

[11] Patent Number: 5,190,252

[45] Date of Patent: Mar. 2, 1993

[54] REFUSE BAG SUPPORT SYSTEM

[76] Inventor: Lawrence A. Schrager, 32 Lincoln Ave., Highland Park, N.J. 08904

[21] Appl. No.: 497,881

[22] Filed: Mar. 23, 1990

[51] Int. Cl.[5] ..... A63B 55/04

[52] U.S. Cl. ..... 248/97; 248/99

[58] Field of Search ..... 248/95, 97-101; 312/184; 220/404, 1 T

[56] References Cited

U.S. PATENT DOCUMENTS

| | | | |
|---|---|---|---|
| 2,625,973 | 1/1953 | Weldon et al. | 248/99 X |
| 3,916,962 | 11/1975 | Stolt | 248/101 X |
| 3,977,450 | 8/1976 | Schampier | 220/404 X |
| 3,995,924 | 12/1976 | Jones | 248/95 X |
| 4,538,862 | 9/1985 | Chandler | 312/184 X |
| 4,717,215 | 1/1988 | Everts | 312/184 |
| 4,750,638 | 6/1988 | Sosower | 220/404 |
| 4,979,705 | 12/1990 | Bovitz | 248/97 |

FOREIGN PATENT DOCUMENTS

| | | | |
|---|---|---|---|
| 618563 | 11/1932 | Fed. Rep. of Germany | 312/184 |
| 1245313 | 3/1966 | Fed. Rep. of Germany | 312/184 |
| 1121585 | 3/1954 | France | 312/184 |
| 581280 | 8/1958 | Italy | 312/184 |
| 183700 | 4/1936 | Switzerland | 312/184 |
| 742397 | 12/1955 | United Kingdom | 211/12 |

*Primary Examiner*—Alvin C. Chin-Shue

*Attorney, Agent, or Firm*—Charles J. Brown

[57] ABSTRACT

A refuse bag support system for sorting and storing refuse of varying types and volume in a bag-holding structure of a total volume which is substantially less than the total volume of side-by-side bags therein if all were filled to capacity, including a pair of arms holding each bag which are movable apart to widen the associated bag opening and movable together to narrow it.

12 Claims, 3 Drawing Sheets

REFUSE BAG SUPPORT SYSTEM

BACKGROUND OF THE INVENTION

Sorting of refuse into various categories, such as clear and colored glass, metals, plastics, etc., not only is recognized as an environmentally commendable practice but is fast becoming a legal mandate in many areas. It has resulted in a proliferation of new devices for facilitating the refuse sorting process particularly in residential households. Various multiple compartment refuse containers have been proposed, such as those in U.S. Pat. Nos. 4,834,262 and 4,834,253 and earlier in U.S. Pat. No. 3,893,615, and simpler forms presumably not patented are commercially available. All have one aspect in common and that is that they present multiple refuse-receiving compartments to the user which are of fixed size.

The types of refuse requiring sorting, however, are not generated in equal amounts. One household may produce several times the volume of colored glass bottles as it does aluminum cans. Another may generate waste plastic in only a fraction of the volume of clear glass refuse. Prior art multiple compartment refuse containers occupy a total space in which one compartment may be totally filled with cans while next to it another compartment of equal size is inefficiently filled only to a fraction of its capacity with plastic bottles.

It is the principal object of this invention to provide refuse bag holding means of a total volume which is substantially less than the total volume of the bags if all were filled to capacity. Put another way it is the purpose of the invention to reduce the size of a multiple compartment refuse container as much as possible such that bags holding refuse of large volume can expand as needed at the expense of bags which need only minimal space to receive refuse generated in lesser volume.

STATEMENT OF THE INVENTION

A refuse bag support system is provided by the invention for sorting and storing refuse of various types and volumes in a plurality of side-by-side bags. The support means includes a plurality of arms each with means for releasably supporting an edge portion of a bag opening. Bag-holding means are provided of a total volume which is substantially less than the total volume of the bags if all were filled to capacity. The arms are mounted in pairs on the bag holding means with one bag gripped by each pair of arms. Displacement means are included for selectively moving the arms of each pair thereof apart for widening the opening of the associated bag and toward one another for narrowing that opening.

In all forms of the invention the bag-holding means may be an open-top container and underlying means, such as the bottom of the bag-holding means, may be included for carrying the weight of the bag contents and relieving the arms of that weight. The arms may be rigid or flexible. If the arms are rigid they may be pivotably mounted on a central hub and slidable along an upper periphery of the structure so that the arms of each pair may be displaced angularly apart for widening the opening of the associated bag and angularly toward one another for narrowing that opening. Alternatively rigid arms of each pair may be substantially parallel and span opposed edges of a box-like bag-holding structure so as to be selectively slidable at their ends along the edges of the structure to displace the arms apart for widening the opening of the associated bag and toward one another for narrowing that opening. If the arms are flexible they may be releasably secured at their ends side-by-side in diametrically opposite locations on a circular periphery of the bag-holding structure and be longer than the diameter of the periphery, so as to snap between two positions, one wherein the arms of a given adjacent pair are bowed apart to open the associated bag and the other wherein teh arms of a given pair are bowed together to close the associated bag.

In all forms of the invention the total volume of the bag holding means is substantially less than the total volume of the bags if all were filled to capacity. The bags holding refuse of large volume then expand as needed at the expense of bags which need only minimal space to receive refuse generated in lesser volume.

DESCRIPTION OF THE PREFERRED EMBODIMENT

Figure 1:
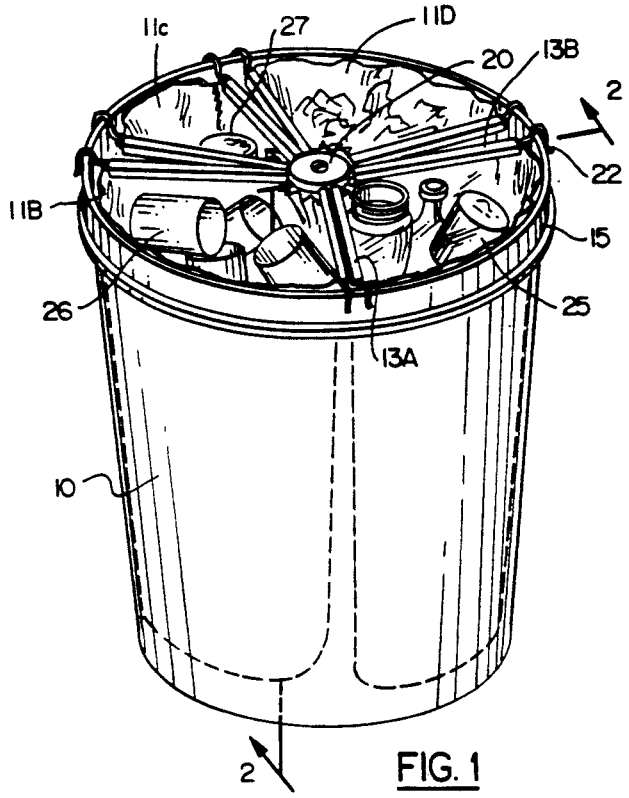
FIG. 1 is a pictorial view of that embodiment of the invention wherein the bag supporting arms are angularly displacable with respect to one another.
Figure 2:
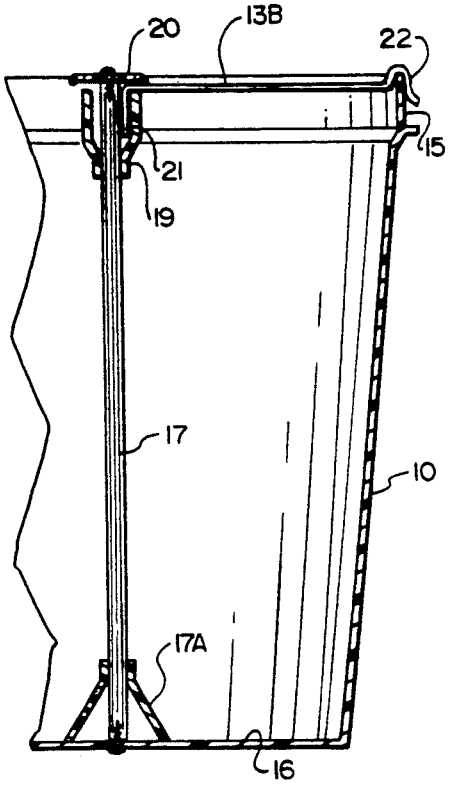
FIG. 2 is a fragmentary vertical section taken along the line 2—2 of FIG. 1.
Figure 3:
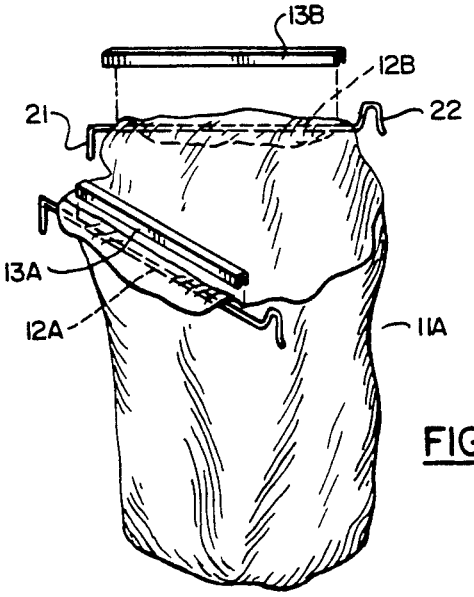
FIG. 3 is an exploded pictorial view of one pair of the arms and associated bag of the embodiment of FIG. 1.

Referring first to the embodiment of FIGS. 1 to 3, the apparatus of the invention includes a substantially cylindrical open-top container 10 of generally conventional form, typically of plastic material. The open top of the container 10 may be closed by a suitable conventional lid which is optional and therefore not here shown. The object is to incorporate plastic refuse bags in the container 10 in a manner such that bags holding refuse of large volume can expand as needed at the expense of bags which need only minimal space to receive refuse generated in lesser volume. In this embodiment four plastic bags 11A, 11B, 11C and 11D are illustrated in the container 10. The total volume of the container 10 is substantially less than the total volume of the bags 11A to 11D if all were filled to capacity.

The bag 11A is shown in FIG. 3 in association with a pair or rigid arms 12A and 12B typically formed of an appropriately bent still metal rod. The rigid arms 12A and 12B are equipped with means for releasably gripping an edge portion of the opening of the bag 11A. In this embodiment the gripping means are respective conventional resilient plastic channel elements 13A and 13B which are force-fitted down over the associated edge portion of the bag 11A and underlying arm as shown in FIG. 3.

Each of the bags 11B to 11D has a pair of arms associated with it similar to the arms 12A and 12B associated with the bag 11A, and each pair of such arms is also equipped with gripping means similar to the channel elements 13A and 13B.

As shown in FIG. 2 the container 10 includes a circular upper periphery position 15 and a bottom 16. An axial post 17 is appropriately mounted at 17A at the center of the bottom 16 of the container 10. The top of the post 17 is substantially in the plane of the circular upper periphery of the container 10 and supports a hub 18. The hub device 18 includes a journal 19 concentrically surrounding the top portion of the post 17 and fixed to it at its lower end. A removable cap 20 is releasably secured in concentric position to the top end of the post 17. Alternatively the hub could be mounted at the end of a bracket cantilevered from the periphery portion 15 rather than on the top of the post 17.

In FIGS. 2 and 3 the arm 12B is shown to include a right-angle end segment 21 which is fitted downwardly into the space between the journal 19 and the top portion of the post 17 when the cap 20 is removed. All of the other rigid arms of this embodiment include an end segment similar to the end segment 21. At the opposite end of the arm 12B is a crooked portion 22 which overlies and is in slideable engagement with the upper periphery 15 of the container 10 when the angled end segment 21 is in place within the journal 19. All of the arms in this embodiment include an outer end portion similar to the crooked portion 22. When all of the rigid arms and the cap 20 are in place as shown in FIG. 2, the inner end of each arm is pivotably mounted on the hub 18 and the other end of each arm is slideable along the upper peripher 15 of the container 10.

In use edge portions of the bags 11A to 11B are releasably gripped by a pair of the adjacent arms and their channel elements, such as the arms 12A and 12B and their associated channel elements 13A and 13B of FIG. 3. The bottom 16 of the container 10 carries the weight of the bag contents and relieves the arms of that weight. Various types of refuse are selectively placed in the respective bags. For example, bottles 25 may be placed in the bag 11A, cans 26 may be placed in the bag 11B and refuse of some other type 27 may be placed in the bag 11C. In this example a relatively large volume of cans 26 is shown to have been placed in the bag 11B as compared to the lesser volume of refuse 27 placed in the bag 11C. Therefore the pair of arms associated with the bag 11B are displaced angularly apart to widen the opening of that bag and the pair of arms associated with the bag 11C are displaced angularly toward one another to narrow its opening. The bag 11B holding refuse of relatively large volume can then expand as needed at the expense of the bag 11C which need only occupy minimal space in the container 10 to recieve its refuse 27 generated in lesser volume. When one or more of the bags 11A to 11D is filled it may be selectively removed and replaced with an empty bag.

Figure 4:
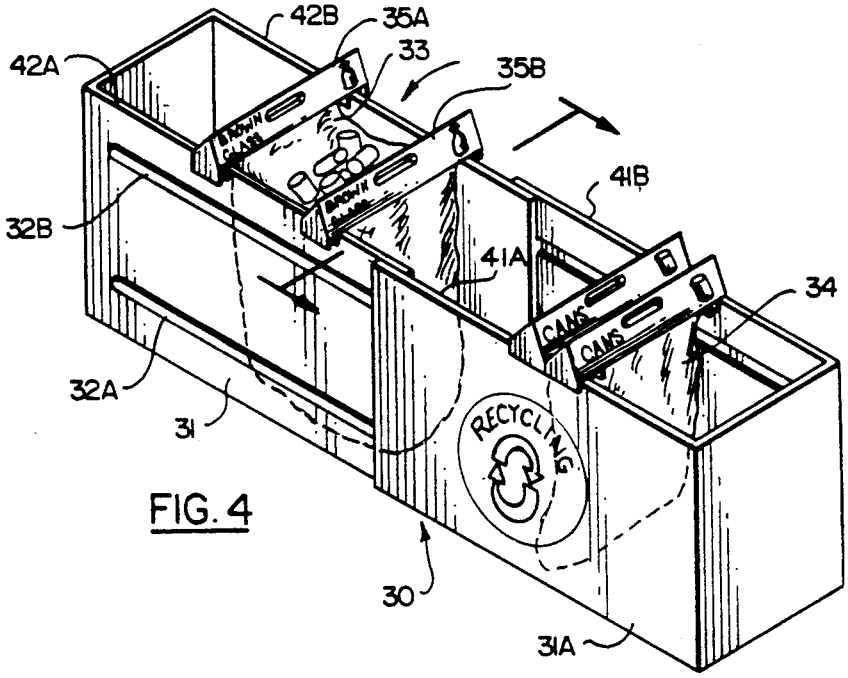
FIG. 4 is a pictorial view of the embodiment of the invention wherein the bag supporting arms are parallel and linearly displacable with respect to one another.
Figure 5:
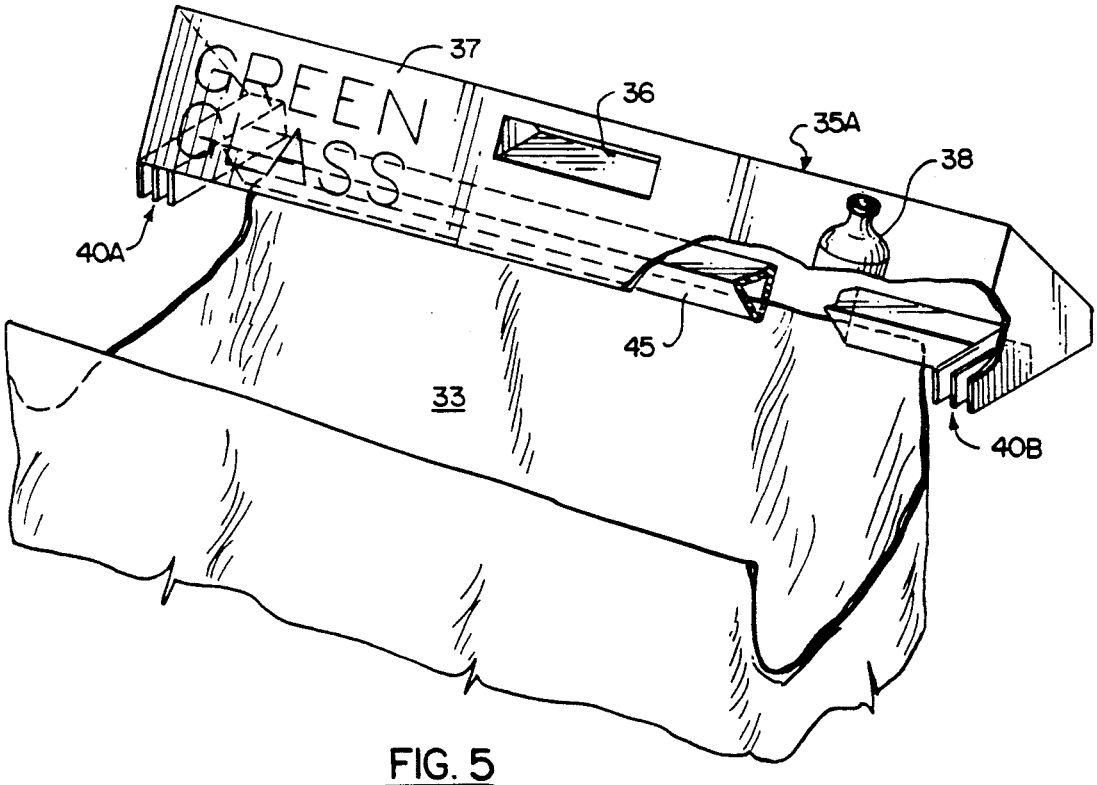
FIG. 5 is an enlarged fragmentary pictorial view of one arm of one pair of the arms and associated bag of the embodiment of FIG. 4.

Turning now to FIGS. 4 and 5 an embodiment of the invention is shown which in principle is the same as that of the embodiment of FIGS. 1 to 3. The difference in structure in the embodiment of FIGS. 4 to 5 is that the container 30 is not substantially cylindrical but instead is an open-top box-like container. Again, an appropriate lid may be provided if desired. The box-like container 30 may be formed of telescopic sections 31 and 31A which can expand or contract the size of the container 30 to accommodate various numbers of bags. Suitable tracks 32A and 32B are provided along each side of the inner section 31 of the telescopic container 30 to guide the sections during their relative movement.

Only two bags 33 and 34 are shown in FIG. 4 thereof. It is to be understood that in the preferred operation of this apparatus more bags will be included so that during use they are side-by-side and occupy the entire inner volume of the container 30. Each of the bags is associated with a pair of rigid arms such as the arms 35A and 35B associated with the bag 33. As shown in FIG. 5 the arm 35A is of generally triangular lateral cross section for rigidity and may include a finger aperture 36 for easy gripping. It may also include suitable indicia in words 37 or pictures 38 indicating the type of refuse to be deposited in the associated bag 33. The opposite ends of the rigid arm 35A include tripie flanges 40A and 40B each of which defines a pair of downwardly directed slots. The opposite outer pairs of slots are adapted to fit over the upper parallel opposed edges 41A and 41B of the outer telescopic container section 31A and the inner pair of slots are adapted to fit over the upper edges 42A and 42B of the inner telescopic section 31 of the container. Thus the rigid arm 35A can be used with either one of the telescopic sections 31 or 31A.

The rigid arm 35A also includes means for releasably gripping edge portions of the opening of the bag 33. This could be a rod and asociated channel element as in the embodiment of FIGS. 1 to 3 but for illustration of possible options the embodiment of FIGS. 4 and 5 is shown with gripping means comprising a resilient channel 45 having side flanges which are biased together at their outer edges and which can be pried apart manually to receive and pinch an edge portion of the bag 33.

It is to be understood that all of the rigid arms in the embodiment of FIGS. 4 and 5 are of a construction similar to that described above in connection with the rigid arm 35A. It is also to be understood as in the previous embodiment that the bag holding container 30, even in its expanded form, has a total volume which is substantially less than the total volume of the bags it is designed to contain if all were filled to capacity.

The arms of each pair are substantially parallel as shown in FIG. 4, they span the opposed edges 41A–41B and 42A–42B of the structure and they are selectively slidable at their ends along the edges of the structure to displace the parallel arms of each pair apart for widening the opening of the associated bag and toward one another for narrowing that opening.

The operation of the embodiment of FIGS. 4 and 5 is similar to that of FIGS. 1 to 3 in that the bags holding a type of refuse of large volume can expand as needed at the expense of bags which need only minimal space to receive refuse generated in lesser volume. Also as in the previous embodiment the bottom of the container 30 carries the weight of the bag contents and releives the arms of that weight.

Figure 6:
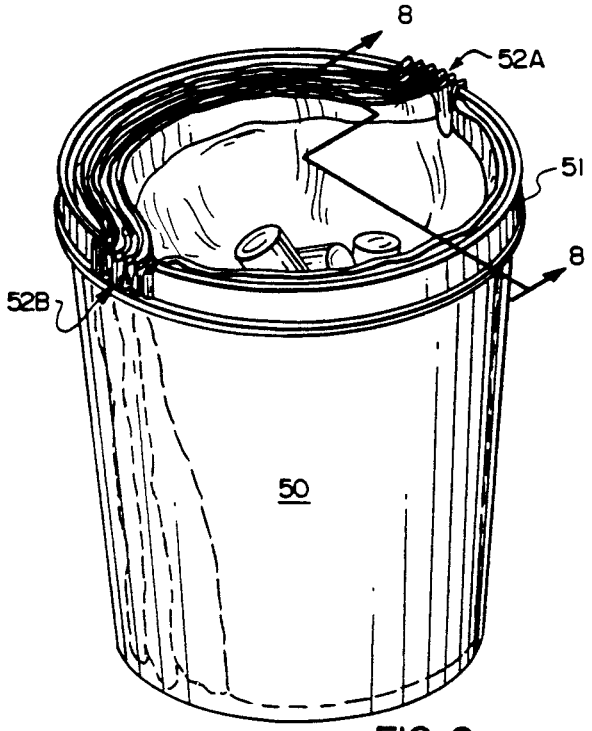
FIG. 6 is a pictorial view of that embodiment of the invention wherein the bag supporting arms are flexible and can be snapped between bowed apart and bowed together positions.
Figure 8:
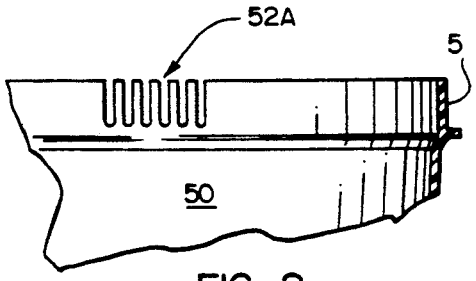
FIG. 8 is an enlarged fragmentary section taken along the line 8—8 of FIG. 6 with the arms removed and showing slots in the container periphery for holding the ends of the arms.
Figure 7:
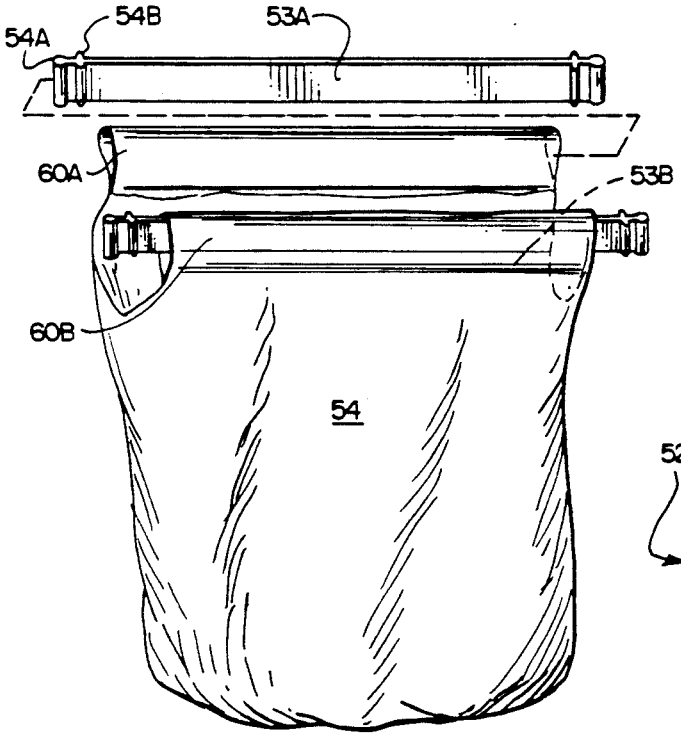
FIG. 7 is an exploded pictorial view of one pair of the arms and associated bag of the embodiment of FIG. 6.

Turning now to the embodiment of FIGS. 6 to 10 a container 50 is provided which is very similar to the container 10 of the embodiment of FIGS. 1 to 3 in that it is substantially cylindrical and open-topped. Again, a lid may be provided. The container 50 includes a substantially circular upper periphery 51 which includes slots 52A and 52B at diameterically opposite locations on the circular periphery 51. A plurality of flexible arms are provided each with means for releasably supporting an edge portion of a bag opening. A pair of such arms 53A and 53B are shown in FIG. 7 associated with a bag 54. The arms 53A and 53B and all others like them in this embodiment may be formed of strips of flexible plastic. At the opposite ends of each arm are a pair of outer and inner probruberances 54A and 54B. The arms are releasably secured at their ends side-by-side in the diametrically opposite locations on the circular periphery 51 simply by sliding the arm ends down into the slots so that the protruberances 54A and 54B restrain each arm end portion against movement radial to the periphery 51. Alternative means for releasably fitting the ends of the arms in place include forming an eyelet in each end of each arm and fitting it down over the upstanding fingers on the periphery 51 shown in FIG. 8 which define the slots 52A.

Figure 9:
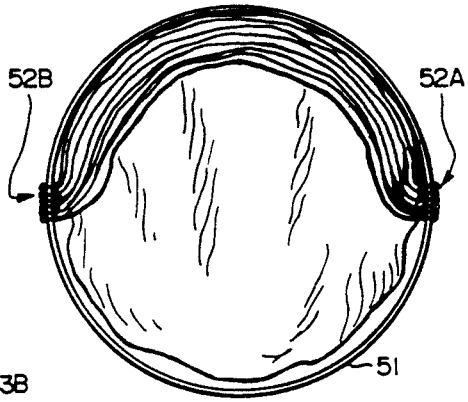
FIG. 9 is a top plan view of the embodiment of FIG. 6 showing all of the bag supporting arms in their bowed together position closing the associated bags.
Figure 10:
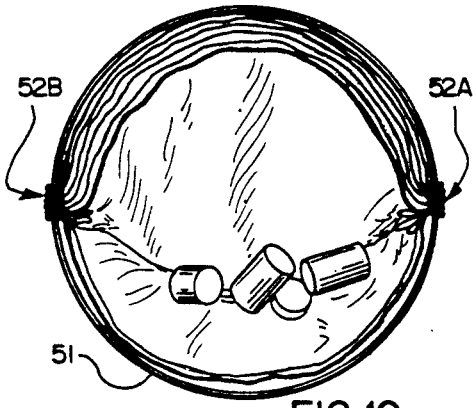
FIG. 10 is a top plan view of the embodiment of FIG. 6 showing one of the pairs of arms in the bowed apart position holding the associated bag open.

Each of the flexible arms in the embodiment of FIGS. 6 to 10 is substantially longer than the diameter of the periphery 51 as is clearly shown in FIGS. 6, 9 and 10. Since the arms are flexible they can be snapped between two positions, one wherein the arms of a given adjacent pair are bowed apart and the other wherein the arms of an adjacent pair are bowed together. Each time a given arm is moved from one such position to the next it snaps over dead center and as it does so is briefly of a somewhat S-configuration.

The bag 54 in FIG. 7 is shown to include a pair of open-ended seams 60A and 60B on its edge portions through which the respective arms 53A and 53B are inserted when the bag 54 is placed within the container 50. This is only one optional means for releasably supporting the edge portion of the opening of the bag 54. Adaptations of the releasable supporting means of the embodiments of FIGS. 1 to 3 or of FIGS. 4 and 5 may also be employed. The bottom of the container 50 carries the weight of the contents of the bag 54 and relieves the releasable supporting means of that weight.

In FIG. 9 all of the pairs of flexible arms and their associated bags are shown bowed together so that the openings of all the bags are held closed. In FIGS. 6 and 10 the first pair of adjacent flexible arms are shown bowed apart thereby opening the associated bag to receive refuse. In operation each bag may be selectively accessed in turn by snapping one or more of the pairs of flexible arms over dead center until the desired opened bag is reached. As in the two prior embodiments the total volume of the container 50 is substantially less than the total volume of the bags it contains if all were filled to capacity. The bags holding refuse of large volume can expand as needed at the expense of bags which need only minimal space to receive refuse generated in lesser volume.

When "bags" are referred to herein and in the following claims it is intended to mean not only conventional plastic refuse bags but also other flexible containers such as sling-like elements for holding appropriately shaped refuse similar in a sense to slings used for carrying small amounts of firewood, or accordion-like elements which may expand or contract or even materials of stretchable or extensible or telescopic capability. It is also to be understood that the invention is not to be limited to containers such as 10, 30 and 50 which fully enclose bags. Open frameworks are also to be included in the bag-holding means of the invention. Indicia such as the words 37 or pictures 38 may be incorporated in the embodiments of FIGS. 1 to 3 and FIGS. 6 to 10 by appropriate means, just as in the embodiment of FIGS. 4 and 5.

The scope of the invention is to be determined by the following claims rather than be the foregoing description of preferred embodiments.

I claim:

1. A refuse bag support system for sorting and storing refuse of varying types and volumes comprising a) a plurality of side-by-side bags, b) a plurality of arms each with means for releasably supporting an edge portion of an opening of one of said bags, c) bag-holding means comprising an open top container having side walls and containing said plurality of bags and having a total volume which is substantially less than the total volume of said plurality of bags if all were filled to capacity, d) said arms being mounted in pairs of the bag-holding means with one bag gripped by each pair of arms, e) underlying means supporting and carrying the weight of the contents of each bag and relieving the arms of that weight, and f) displacement means for selectively moving the arms of each pair thereof apart for widening the opening of the associated bag and toward one another for narrowing that opening.

2. A refuse bag support system according to claim 1 wherein the underlying means is a bottom on the bag-holding means.

3. A refuse bag support system for sorting and storing refuse of varying types and volumes comprising a) a plurality of side-by-side bags, b) a plurality of rigid arms each with means for releasably gripping an edge portion of an opening of one of said bags, c) a bag-holding structure comprising an open top container having side walls and being of a total volume which is substantially less than the total volume of said plurality of the bags if all were filled to capacity, d) an upper periphery on said structure on which the arms are movably mounted in pairs with one bag gripped by each pair of arms, e) a bottom in the structure supporting and carrying the weight of the contents of each bag and relieving the arms of that weight, and f) displacement means for selectively sliding at least one end of each arm along the upper periphery of the structure to move the arms of each pair away from one another for widening the opening of the associated bag and toward one another for narrowing that opening.

4. A refuse bag support system for sorting and storing refuse of varying types and volumes in a plurality of side-by-side bags comprising a) a plurality of rigid arms each with means for releasably gripping an edge portion of a bag opening, b) an open-topped bag-holding structure of a total volume which is substantially less than the total volume of the bags if all were filled to capacity, c) a substantially horizontally disposed circular upper periphery on said structure and a fixed arm-supporting hub concentrically located on a substantially vertical axis within that periphery and on which the arms are movably mounted in pairs with one bag gripped by each pair of arms, d) a bottom in the structure for carrying the weight of the bag contents and relieving the arms of that weight, and e) one end of each arm being pivotably mounted on said hub and the other end of each arm being slideable along the upper periphery of the structure so that the arms of each pair may be displaced angularly apart for widening the opening of the associated bag and angularly toward one another for narrowing that opening.

5. A refuse bag support system according to claim 4 wherein the structure is a substantially cylindrical open-topped container.

6. A refuse bag system according to claim 7 wherein the hub is mounted on a bracket cantilevered from the upper periphery of said structure.

7. A refuse bag support system for sorting and storing refuse of varying types and volumes comprising a) a plurality of side-by-side bags, b) a plurality of rigid arms each with means for releasably gripping an edge portion of an opening of one of said bags, c) a bag-holding structure comprising an open top container having side walls and being of a total volume which is substantially less than the total volume of said plurality of the bags if all were filled to capacity, d) upper parallel opposed edges on said structure on which the arms are movably mounted in pairs with one bag gripped by each pair of arms, e) a bottom in the structure supporting and carrying the weight of the contents of each bag and relieving the arms of that weight, and f) the arms of each pair being substantially parallel and spanning the opposed edges of the structure and being selectively slidable at their ends along the edges of the structure to displace the parallel arms of each pair apart for widening the opening of the associated bag and toward one another for narrowing that opening.

8. A refuse bag support system according to claim 7 wherein the bag-holding structure comprises telescopic sections which can expand or contract the container size to accommodate various numbers of bags.

9. A refuse bag support system for sorting and storing refuse of varying types and volumes comprising a) a plurality of side-by-side bags, b) a plurality of flexible arms each with means for releasably supporting an edge portion of an opening of one of said bags, c) a bag-holding structure comprising an open top container having side walls and being of a total volume which is substantially less than the total volume of said plurality of the bags if all were filled to capacity, d) a substantially circular upper periphery on said structure on which the arms are mounted in pairs with one bag gripped by each pair of arms, and e) a bottom in the structure supporting and carrying the weight of the contents of each bag and relieving the arms of that weight, f) all of the flexible arms being releasably secured at their end side-by-side in diametrically opposite locations on the circular periphery of the structure and being longer than the diameter of the periphery so as to snap between two positions one wherein the arms of a given adjacent pair are bowed apart to open the associated bag and the other wherein the arms of a given pair are bowed together to close the associated bag.

10. A refuse bag support system according to claim 9 wherein the structure is a substantially cylindrical open-topped container.

11. A refuse bag support system according to claim 9 wherein the ends of the arms are releasably fitted in respective slots in the container periphery and restrained against movement radial to that periphery.

12. A refuse bag support system for sorting and storing refuse of various types and volumes in a plurality of side-by-side bags comprising a) a plurality of rigid arms each with means for releasably gripping an edge portion of a bag opening, b) substantially cylindrical open-topped container of a total volume which is substantialy less than the total volume of the bags if all were filled to capacity, c) a circular upper periphery on said container and a fixed arm-supporting hub concentrically located within that periphery and on which the arms are movably mounted in pairs with one bag gripped by each pair of arms, d) a bottom in the container for carrying the weight of the bag contents and relieving the arms of that weight, e) an axial post extending from the bottom of the container on which the hub is mounted, and f) one end of each arm being pivotably mounted on said hub and the other end of each arm being slidable along the upper periphery of the container so that the arms of each pair may be displaced angularly apart for widening the opening of the associated bag and angularly toward one another for narrowing that opening.

* * * * *